United States Patent [19]

Stritzke

[11] Patent Number: 5,050,893

[45] Date of Patent: Sep. 24, 1991

[54] VALVE STEM OIL SHIELD

[75] Inventor: Bernard G. Stritzke, Roselle, Ill.

[73] Assignee: Macrotech Fluid Sealing, Inc., Salt Lake City, Utah

[21] Appl. No.: 584,779

[22] Filed: Sep. 19, 1990

[51] Int. Cl.[5] ..... F01L 3/08; F16J 15/56

[52] U.S. Cl. ..... 277/178; 123/188 P; 277/33; 277/206 R

[58] Field of Search ..... 277/33, 178, 212 R, 277/177, 181, 182, 183, 184, 206 R; 123/188 P, 90.37; 16/2

[56] References Cited

U.S. PATENT DOCUMENTS

| | | | |
|---|---|---|---|
| 2,878,799 | 3/1959 | Brenneke | 123/188 P |
| 3,090,115 | 5/1963 | Carr | 16/2 |
| 3,228,384 | 1/1966 | Brown | 123/90.37 |
| 3,372,941 | 3/1968 | Liebig | 277/212 R |
| 4,474,379 | 10/1984 | Holzer | 277/178 X |
| 4,947,811 | 8/1990 | Binford | 123/188 P |

*Primary Examiner*—Allan W. Shoap

*Attorney, Agent, or Firm*—Lyon & Delevie

[57] ABSTRACT

A valve stem oil shield comprises a cup-shaped deflector having a radial flange with an aperture therein for the acceptance of the valve stem. An annular grommet of U-shaped cross-section is disposed between the deflector and the valve stem to mechanically secure the oil shield to the valve stem. Leg portions of the grommet slidably engage the deflector thereby to effect a seal between the deflector and valve stem.

1 Claim, 1 Drawing Sheet

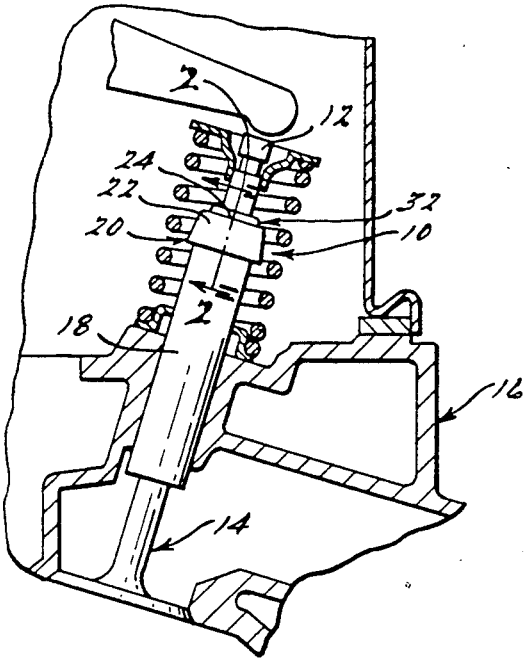
FIG. 1.
FIG. 4.
Prior Art
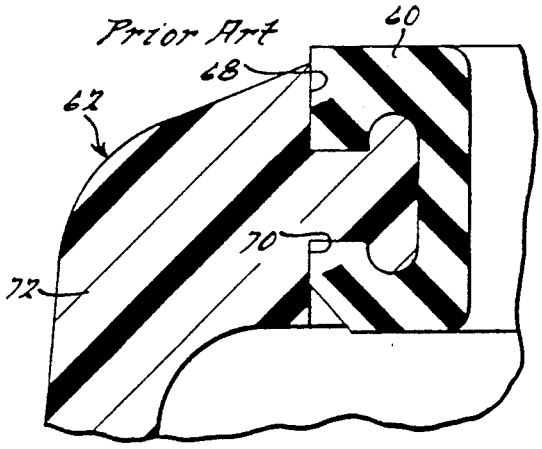
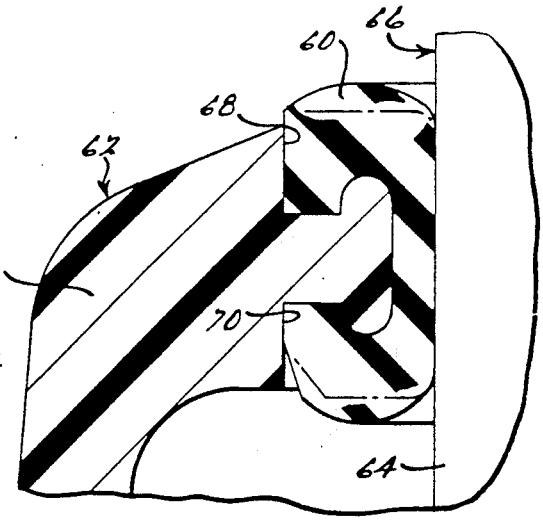
Prior Art
FIG. 5.
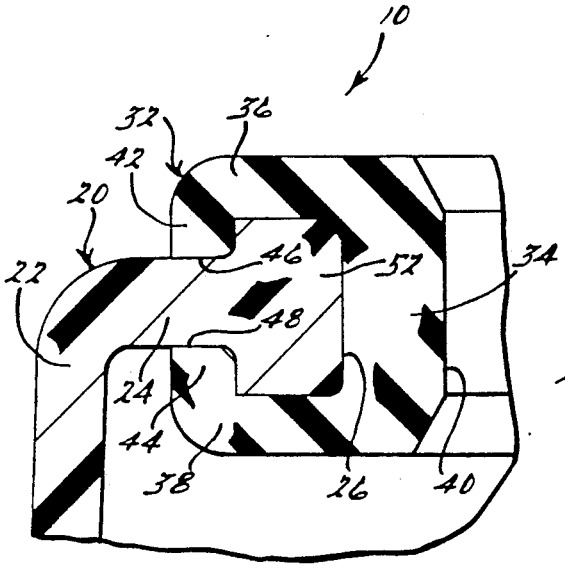
FIG. 3.
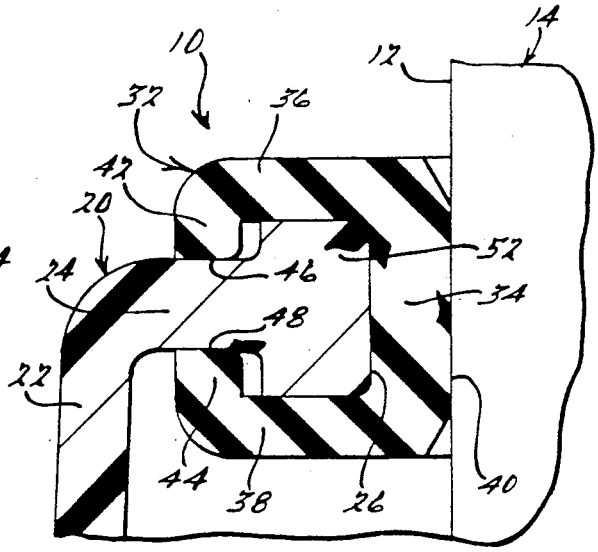
FIG. 2.

VALVE STEM OIL SHIELD

BACKGROUND OF THE INVENTION

Valve stem oil shields are used to attenuate the passage of oil between the stem of a valve and the valve guide of an internal combustion engine. Such oil shields are generally secured to the valve stem by a resilient element so as to reciprocate with the valve. One problem exhibited by such known shields is that prolonged compression of the resilient element plus tolerance stackup may result in compression set of the resilient gripping portion of the oil shield due to the combination of high unit pressure on the resilient element and the high temperature environment in which the valves operate.

A seal faced with the aforesaid problem is taught in Liebig U.S. Pat. No. 3,372,941 entitled "Valve Seal". The mounting configuration of a resilient element on the oil deflector of the valve stem oil shield places the element in compression and does not accommodate tolerance stackup of, for example, an undersized deflector and an oversized valve stem. The resultant high unit pressure on the resilient element leads to compression set thereof and premature failure of the oil shield.

SUMMARY OF THE INVENTION

The instant invention relates to a valve stem oil shield that takes advantage of a known phenomenon that while rubber sets in the presence of heat and compression, it contracts in the presence of heat and tension. The shield is mounted on the valve of an internal combustion engine so as to shield the valve stem and valve guide from the environment of the valve chamber yet accommodate tolerance deviation of the components. The oil shield comprises a cup-shaped oil deflector that supports an annular resilient grommet of generally U-shaped radial cross-section. End portions of the legs of the U-shaped cross-section are placed in tension upon assembly of the shield with a valve so as to slidably and sealably engage a radial flange on the deflector without danger of compression set. The grommet has a radially inwardly facing sealing surface that engages the valve stem to both seal against the passage of oil along the valve stem and secure the shield to the valve for reciprocation therewith.

BRIEF DESCRIPTION OF THE DRAWINGS

FIG. 1 is a fragmentary view, partially in section, of the valve stem oil shield in its operating environment;

FIG. 2 is a cross-sectional view taken along the line 2—2 of FIG. 1;

FIG. 3 is a view of the valve stem oil shield of FIG. 2 prior to assembly onto the stem of a valve;

FIG. 4 is a fragmentary sectional view of a prior art oil shield prior to assembly on a valve stem; and FIG. 5 is a view showing the shield of FIG. 4 assembled on a valve stem.

DETAILED DESCRIPTION OF THE PREFERRED EMBODIMENT OF THE INVENTION

As seen in FIG. 1, a valve stem oil shield 10, in accordance with a constructed embodiment of the present invention, is mounted on a stem 12 of a valve 14 of an internal combustion engine 16. The shield 10 mechanically grips the stem 12 of the valve 14 to minimize flow of oil past a valve guide 18 of the engine 16.

In accordance with the instant invention, and as best seen in FIGS. 2 and 3, the oil shield 10 comprises a cup-shaped oil deflector 20 defined by a generally cylindrical skirt portion 22 and a radially extending flange portion 24. The flange portion 24 of the deflector 20 has a central aperture 26 for the acceptance of an annular resilient elastomeric grommet 32. The grommet 32 is of generally U-shaped radial cross-section defined by a bight portion 34 and spaced leg portions 36 and 38. The grommet 32 has a radially inwardly facing sealing surface 40 that engages the valve stem 12. The radially extending leg portions 36 and 38 of the grommet 32 have axially extending end portions 42 and 44 with axially facing sealing surfaces 46 and 48, respectively, that engage the radially inwardly extending flange 24 on the deflector portion 20 of the shield 10. The flange 24 of the deflector 20 has an enlarged radially inner end portion 52 that cooperates with the radially extending legs 36 and 38 and the axially extending end portions 42 and 44 thereon of the grommet 32 to retain the grommet 32 on the deflector 20.

The improvement taught by the instant invention is best seen by comparing FIGS. 2 and 3, which illustrate the present invention, with FIGS. 4 and 5 which illustrate the prior art. As seen in FIGS. 4 and 5, a resilient element 60 of a prior art oil shield 62 is totally compressed between a stem 64 of a valve 66 and axially extending shoulders 68 and 70 on a deflector portion 72 of the shield 62. Thus, as best seen in FIG. 5, the resilient element 60 must flow axially relative to the deflector 72 and at all times is under extreme compression. When manufacturing tolerance deviations result in an oversize valve stem 64 and an undersize deflector 72, tolerance stackup may result in compression set of the resilient element 60 leading to premature failure of the oil shield 62.

In contradistinction, as best seen by comparing FIGS. 2 and 3, the leg portions 36 and 38 of the grommet 32 are free to float radially relative to the flange 24 on the deflector portion 20 thereof relieving excessive unit pressure in the grommet 32 while the faces 42 and 44 on the legs 36 and 38 of the grommet 32 maintain sealing engagement with the flange 24 of the oil deflector 20. Radial expansion of the grommet 32 results in the legs 36 and 38 being placed in tensioned hoop stress which results in contraction in high heat conditions as opposed to heat set. Thus, unit stress in the grommet 32 is controlled to insure mechanical retention of the shield 10 on the valve 66.

While the preferred embodiment of the invention has been disclosed, it should be appreciated that the invention is susceptible of modification without departing from the scope of the following claims.

I claim:

1. An oil shield for the valve stem of an internal combustion engine comprising:

a cup-shaped deflector having a generally cylindrical portion with a radially extending flange at one end thereof, the flange of said deflector having a central aperture with an axially enlarged portion on the periphery thereof for the acceptance of a valve stem; and an annular resilient grommet mounted in the aperture in the radial flange of said deflector, said grommet being of generally U-shaped radial cross section defined by an axially extending bight portion and a pair of axially spaced radially outwardly extending leg portions, the bight portion of said grommet being adapted to be compressively engaged between a radially facing face of the axially enlarged portion on the radial flange of said deflector and the valve stem, the leg portions of said U-shaped grommet having axially extending end portions directed toward one another so as to engage the radial flange on said deflector in resilient sealing relationship, the leg portions of said grommet being free to move radially outward upon compression of the bight portion thereof so as to produce tensioned hoop stress in the axially extending end portions thereof whereby subsequent contraction of the leg portions induced by heat increases retention pressure and sealing of the leg portions of said grommet on said deflector.

* * * * *